US005390716A

United States Patent [19]

Gönner et al.

[11] Patent Number: 5,390,716

[45] Date of Patent: Feb. 21, 1995

[54] DEVICE FOR THE SLICING PRODUCTION OF BOARDS

[75] Inventors: Siegmar Gönner, Oberkirch; Braun Heinz-Hubert, Oberkirch-Bottenau, both of Germany

[73] Assignee: Firma Gebuder Linck Maschinenfabrik "Gatterlinck" GmbH & Co. KG, Oberkirch, Germany

[21] Appl. No.: 164,992

[22] Filed: Dec. 10, 1993

Related U.S. Application Data

[63] Continuation of Ser. No. 797,445, Nov. 22, 1991, abandoned.

[30] Foreign Application Priority Data

Dec. 3, 1990 [DE] Germany ..... 4038486

[51] Int. Cl.[6] ..... B26D 1/02

[52] U.S. Cl. ..... 144/175; 144/120; 83/422; 83/856

[58] Field of Search ..... 144/120, 130, 175; 83/422, 856

[56] References Cited

U.S. PATENT DOCUMENTS

| | | | |
|---|---|---|---|
| 405,280 | 6/1889 | Stevens | 144/120 X |
| 1,107,810 | 8/1914 | Loveland | 144/120 |
| 3,783,917 | 1/1974 | Mochizuki | 144/175 |
| 4,917,159 | 4/1990 | Martin | 144/175 |
| 5,010,934 | 4/1991 | Mochizuki et al. | 144/175 |

FOREIGN PATENT DOCUMENTS

| | | |
|---|---|---|
| 2222694 | 11/1973 | Germany . |
| 4029752 | 8/1991 | Germany . |
| 3500 | 5/1917 | Netherlands . |

*Primary Examiner*—Richard K. Seidel
*Assistant Examiner*—Kenneth E. Peterson
*Attorney, Agent, or Firm*—Marshall, O'Toole, Gerstein, Murray & Borun

[57] ABSTRACT

A machine is described for the slicing removal of a board from a cant advanced longitudinally past a blade and pressed, from the side opposite from the blade, by means of a pressing device against the blade and a counterpressure rail mounted in front of the blade. In contrast to conventional constructions, in which driven feed rollers for the cant are located before and beyond the actual slicing device, driven roller pairs are provided directly in the region over which the blade, which forms a very acute angle with the feed direction, extends. The feed roller pairs are moreover floatingly journaled so that they do not affect the position of the cant. By the novel arrangement, an overly lengthy force transmission path through the cant itself from the feed rollers to the blade is avoided.

14 Claims, 3 Drawing Sheets

SECTION A

DEVICE FOR THE SLICING PRODUCTION OF BOARDS

CROSS REFERENCE TO THE RELATED APPLICATION

This is a continuation of U.S. application Ser. No. 07/797,445, filed Nov. 22, 1991, now abandoned.

BACKGROUND OF THE INVENTION

1. Field of the Invention

The invention relates to a device for producing thin boards by chip-free slicing separation of the boards from timber comprising a log or cant and, in particular, to means for feeding the cants in such device.

2. Description of Related Art

German Published Application 37 02 909 and the same applicant's corresponding European Published Application 0277591 and corresponding U.S. Pat. No. 4,825,917, the entire disclosures of which are hereby incorporated by reference disclose a device for the production of thin boards by the chip-free slicing removal of the boards from a log or cant, with a feed path for the cant, a slicing device located at one side of the feed path, a fixed or vibratable slicing blade for severing a board and a counterpressure rail, mounted before the cutting blade. The spacing of the counterpressure rail from the cutting blade, transverse to the feed path of the cant, substantially determines the thickness of the board to be removed and the counterpressure rail is part of a support table for the cant, which table is optionally adjustable in height relative to the blade. The cutting blade and the counterpressure rail subtend an acute angle with the feed path of the cant and a pressing device lies opposite the slicing device at the other side of the feed path and can be pressed against the cant and, thus, the opposed slicing device. Feed rollers are provided for feeding the cant to the cutting blade of the slicing device along the feed path, at least one pair of the feed rollers engaging the cant at opposite sides and clamping the cant therebetween.

In the slicing of boards from a cant, the production of the boards depends on a satisfactory guidance of the cant along the blade. Comparatively high forces are employed for the feeding of the cant relative to the blade, which are applied for example by the feed rollers, which are pressed hard against the cant, the feed rollers being located before and/or after the actual slicing device through which the cant travels.

The forces exerted by the feed rollers on the cant should not adversely affect the satisfactory guiding of the cant in the slicing to the blade, and therefore it was already proposed, in the above-mentioned German Published Application 37 02 909, to journal the feed rollers in pairs floating in the direction transverse to the feed direction of the cants, so that a pair of feed rollers can exert a high clamping force on the cant, which clamping force, however, does not exert any harmful affect on the cant. By these means, it should be ensured that, during the cutting, the pressing of the cant against the blade and the counterpressure rail associated therewith can be adjusted to and maintained at the required level without adversely affecting the feed forces.

During the slicing separation of a cant into thin boards, which are for example further processed into solid wood laminated products, it is desirable to separate a cant completely into such thin boards without an off-size remnant, which is not further processable, being left over. It has now been found that, for a remnant cant, from which several boards have already been removed, the optimum cutting conditions at the blade can not be accurately maintained, despite the feed rollers which are arranged before and after the actual slicing device and which are floatingly supported. This is possibly a consequence of the fact that a previously extensively processed cant no longer possesses sufficient stability to absorb the feed forces in such a manner that they do not affect the slicing region.

BRIEF SUMMARY OF THE INVENTION

Experiments have shown that a cant can furthermore be completely satisfactorily separated into thin boards of substantially uniform quality if feed forces are applied to the cant immediately in the slicing region, but are however not produced by a unilateral pressure.

According to the present invention, at least one feed roller pair is located in that region of the feed path over which the blade extends. In order that the feed forces in no way affect the pressing of the cant against the blade, the or each feed roller pair located in the immediate vicinity of the region over which the blade extends are advantageously constructed so as to be floatingly journaled, in the manner already been proposed in German Published Application 37 02 909 for the feed rollers located outside the slicing region of the machine. Since the arrangement of feed roller pairs on slides movable transversely of the feed path of the timber can result in construction difficulties in this region, a form of the feed rollers in which force is applied by fluid cylinders, the cylinder chambers of which are in flow connection with one another in pairs, is preferred.

It would basically be possible to arrange pairs of feed rollers so that the axes of the rollers extend perpendicular to the slicing plane and thus so that the feed rollers engage the cant from the sides of the opposed slicing and pressing devices. Such a solution could offer construction advantages, since the feed rollers need not engage directly in the region of the blade or in the region of the pressing device, but this embodiment however has the disadvantage that the gripping areas remaining available on the residual cant constantly decrease as the cant is increasingly reduced and the residual cant finally can no longer be sufficiently resistant in its transverse direction to absorb the feed forces.

It is therefore generally necessary to arrange the axes of the feed rollers parallel to the slicing plane, so that the feed rollers always have the same gripping areas on the cant. With this solution, however, spatial construction problems arise.

A typical machine for the slicing production of boards from a cant is for example so constructed that the blade and the slicing plane extend horizontally, the counterpressure rail supported parallel to and in front of the blade edge being part of a support table which supports the cant in front of the blade from below while the pressing device presses the cant from above against the support table and the blade.

In order to produce the smallest possible warping of a board severed by means of the blade, in machines of the type referred to herein, the cutter blades are arranged at a very acute angle, which may for example amount to less than 45°, with respect to the direction of feed of the cant. This acute angle substantially elongates the extent of the region in which the blade is in engagement with the cant along the feed path of the cant, but it simultaneously makes it difficult to provide additional feed elements in the region of the blade.

In the preferred embodiment, the invention therefore provides that, in such a machine, the feed rollers of each of the feed roller pairs located at the blade side of the cant are journaled so as to overhang laterally and in fact at that side of the machine to which the blade edge is directed. The thus-journaled feed rollers engage in recesses provided in the support table, but terminate shortly before the actual counterpressure rail. Correspondingly, these feed rollers have different axial lengths, which decrease from the inlet region of the blade to the outlet region, the free ends of the feed rollers forming substantially a line which extends parallel to the blade edge or the counterpressure rail. It has been shown that, with a sufficiently stable constructional embodiment, sufficient feed forces can be applied to the cant at this region by such feed rollers at the blade side.

The pressing device, which is adjustable and pressable relative to the cant, at the side of the cant opposite from the blade, has for example a series of pressure rollers which can be individually pressurized by means of a fluid cylinder. These pressing rollers can be wrapped by a common moving pressing belt, the operative run of which lies on the cant and advances therewith. The feed rollers of the feed roller pairs, at the pressing side, are suitably each arranged opposite the respective feed rollers at the blade side in the series of pressing rollers, but their pressure controls should be completely independent of the pressing rollers and are experimentally subject to floating control in pairs, with their counter-rollers, as already described. The journaling of the feed rollers at the pressing device side thus, in general, presents no special constructional difficulties. It can however be floating at both sides.

In the case, in particular, of the feed rollers located at the blade side in the recesses in the support table, it is important that they exert on the cant no consequential transverse force which could tend to raise the cant from the support table. Furthermore, the force exerted from the pressing device on the cant, and thus the pressure of the cant on the support table and the blade, must be completely unaffected by the feed rollers.

In order not to have to apply the feed forces for the cant only from the feed rollers arranged in the region over which the blade extends, feed rollers are suitably also arranged at the machine inlet and the machine outlet, as already described in German Published Application 37 02 909, the entire disclosure of which is hereby incorporated by reference.

The description of the invention is directed herein to a single blade and the region of the extent thereof. The features according to the invention are of course applicable to any other slicing device and to any other blade, located in the same machine or in a machine arrangement which has a plurality of slicing devices in succession. Likewise, the pressing device opposed to a blade at the other side of the cant can also be made in the form of a blade arrangement. The arrangement and construction of the feed rollers described as preferred for the blade side of the device is in that case also appropriate for each of the cutting devices at both sides of the cant.

BRIEF DESCRIPTION OF THE DRAWINGS

Further objects, features and advantages of the invention will be more readily apparent to those skilled in the art from the description thereof given below with reference to the accompanying drawings, in which.

DESCRIPTION OF THE PREFERRED EMBODIMENT

Figure 1:
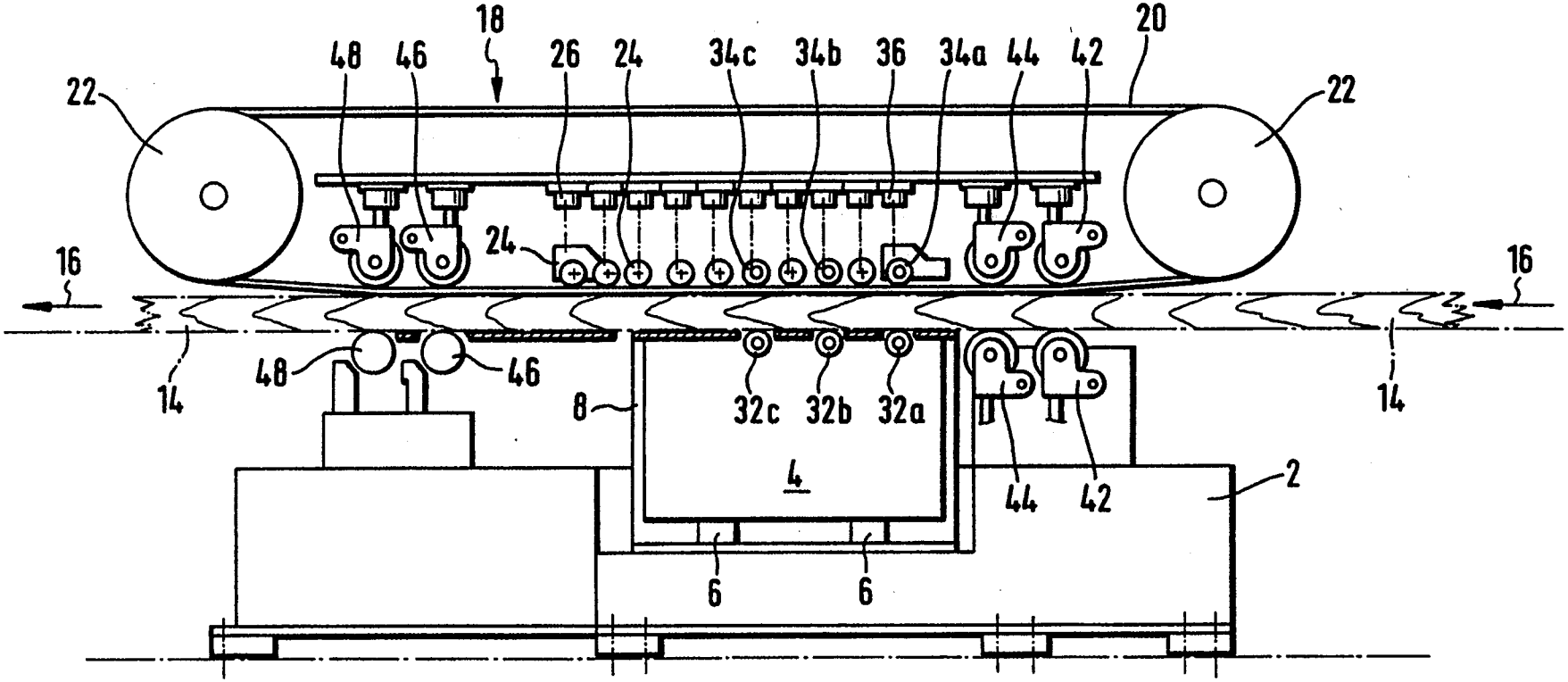
FIG. 1 shows a diagrammatic side elevation of a device for the slicing production of boards from a cant.

The diagrammatic side elevation of a device for the chip-free slicing separation of boards from a cant in FIG. 1 has a machine bed 2 in which a support table arrangement 4 is mounted so as to be adjustable in height. For the purpose of height adjustability, the support table arrangement 4 is mounted on slide posts 6. The drive for the height adjustment is not illustrated in detail and can for example comprise a drive shaft driven by an electric motor. Furthermore, within the machine bed 2 there is provided a blade mounting arrangement 8, which can better be seen from FIG. 3. This blade mounting arrangement can itself be constructed so as to be adjustable in height, but a separate height adjustment of the support table arrangement and of the blade mounting arrangement is however not necessary, so long as it is ensured that the support table can be adjusted in height relative to the blade mounting arrangement. The top of the support table arrangement 4 is formed as a fiat support table 10. Also, the blade support arrangement has an upper bearing surface 12. The support table 10 itself, and the bearing surface 12, can best be seen from FIG. 2.

A cant 14 can be advanced in its longitudinal direction, indicated by arrow 16, over the support table 10 and the bearing surface 12 of the blade mounting arrangement. The cant can be pressed from above onto the support table 10 and the bearing surface 12 of the blade mounting arrangement 8 by means of a pressing device 18. The pressing device 18 is mounted in parts of the machine bed 2 which are, however, not illustrated in the drawings. The pressing device 18 has an endless moving pressing belt 20, which is guided at the ends of the device around deflector rollers 22, which can also be driven. A series of pressing rollers 24 is arranged above the lower run of the pressing belt 20, which lies on the cant 14. The suspension of these pressing rollers 24 in the pressing arrangement 18 is only illustrated diagrammatically. Each of the rollers 24 can be pressed by means of a fluid cylinder 26 against the pressing belt and thus against the cant. The connection between the cylinders 26 and the pressing rollers 24 is illustrated only by broken lines of action. In order that they can be pressed against the cant, the pressing rollers themselves are mounted in substantially horizontal pivot levers within the pressing device 18, so that the roller itself is provided with a certain room for vertical movement.

The height difference between the pressing device 18 and the support table or the bearing surface of the blade mounting arrangement 8 must be variable in order to be able to adapt to different thicknesses of the cant 14. The entire pressing device 18 is therefore generally arranged in the machine base 2 so as to be adjustable in height. It is fixedly adjusted, before the passage of a cant, to a specific cant thickness, while during the entry of the cant into the space between the support table and the pressing device, the pressing rollers, which in turn are movably mounted within the pressing device, are subjected to pressure. It is emphasized that the pressing rollers 24 do not have a rotary drive, since the rollers 24 serve solely for pressing the pressing belt 20 against the cant 14.

Figure 2:
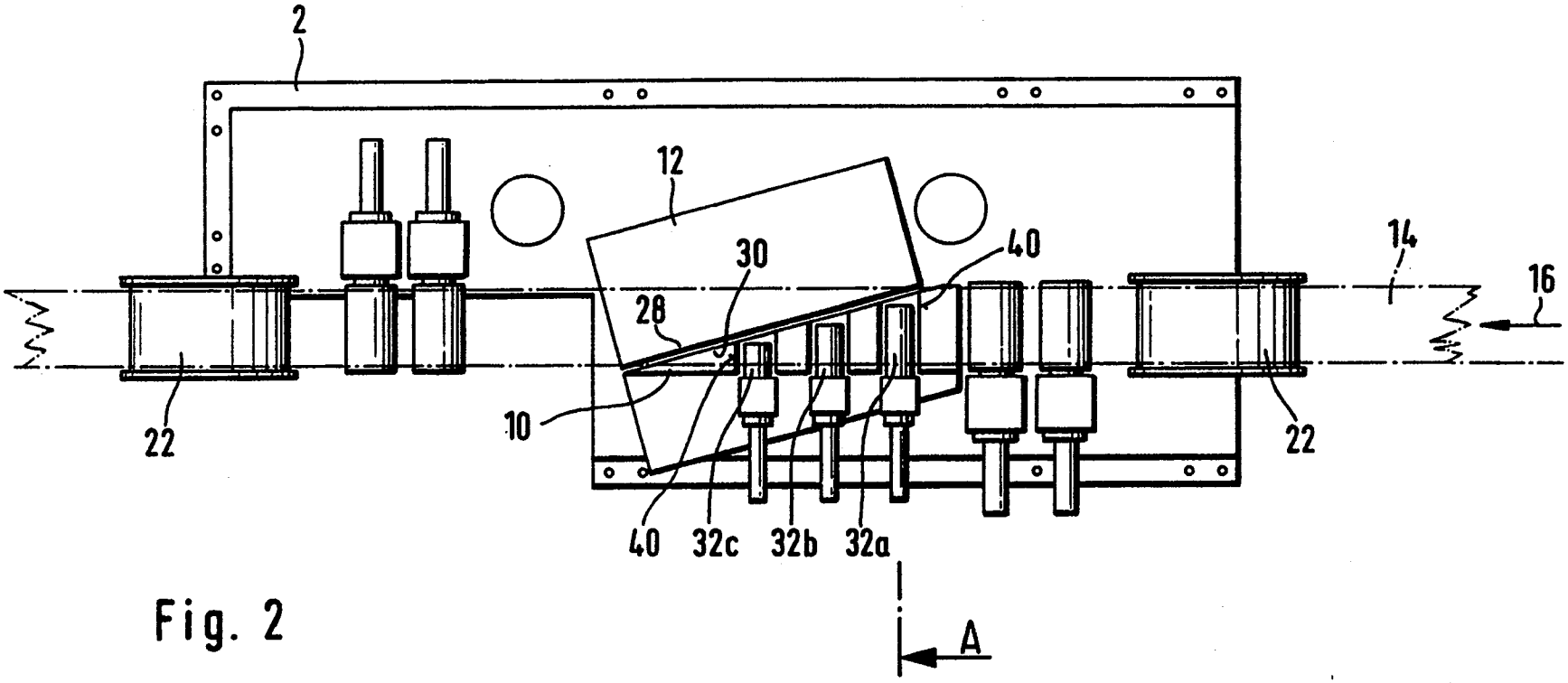
FIG. 2 shows a diagrammatic plan view of the device of FIG. 1, in which however upper parts of the device have been omitted for reasons of clarity.
Figure 3:
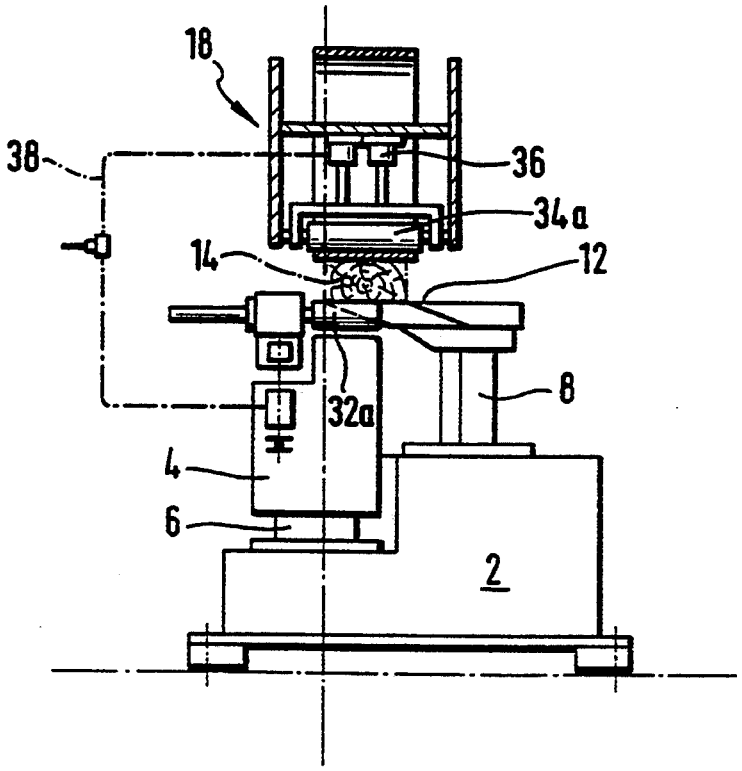
FIG. 3 shows a vertical section along the plane A in FIG. 2.

In FIG. 2, it can be seen that the support table 10 and the bearing surface 12 of the blade mounting arrangement have opposed parallel edges 28 and 30, which form an acute angle, which is substantially less than 45°, with the direction of feed movement 16 or the axis of the cant 14 which is to be processed. The edge 28 of the blade mounting arrangement is the edge of the blade clamped in this arrangement, the precise arrangement and manner of clamping of which are not described in greater detail within the scope of this description. The edge 30 of the support table has a counterpressure rail (not illustrated in detail), which is raised somewhat relative to the surface of the support table and which substantially serves to prevent splitting of the wood when a board is severed by the blade. With reference to the plan view of FIG. 2, the blade edge 28 is located somewhat higher than the edge or counterpressure rail 30 of the support table. This height difference substantially determines the thickness of the boards produced. If the cant is moved from the right against the blade edge 28, a board is severed from the cant, which is fed inclined laterally beneath the bearing surface 12 of the blade mounting arrangement 8. It is clearly apparent that the blade edge 28, by its very acute angle with respect to the feed path 16, extends just in its length, over which it is in engagement with the cant 14, along a not inconsiderable section of the length of the feed path 16.

Three pairs of feed rollers 32*a*, 34*a*; 32*b*, 34*b* and 32*c*, 34*c* are provided, in the region over which the blade 28 extends, for feeding the cant 14. Each pair comprises a lower feed roller 32*a*, 32*b*, 32*c* which is located beneath the cant 14, and an upper feed roller 34*a*, 34*b*, 34*c*, which is located above the cam precisely opposite the lower feed roller and, thus, within the pressing belt 20. This arrangement is best apparent from FIG. 1. The lower feed rollers 32*a–c* are in each case self-driven. A drive for the upper feed rollers 34*a–c* can be omitted if the deflector rollers 22 of the belt 20 are correspondingly driven. It is, however, essential that the feed rollers can be urged against the cant 16 by fluid cylinders 36, which are only partially illustrated, the cylinder chambers of the fluid cylinders of a pair of feed rollers being in flow connection with one another through a duct 38, as illustrated for the feed roller pair 32*a*, 34*a* in FIG. 3. A high clamping force can thus be exerted by a pair of feed rollers on the cant, but the exact vertical position of the pair of feed rollers is not affected by this pressing force and is determined solely by the cant, any vertical movements of which the feed roller pair follows due to the thus-floating construction.

From FIG. 2 it can be seen that the lower feed rollers 32*a*, 32*b* and 32*c* are journaled so as to laterally overhang and engage in recesses 40 in the support table 10. They extend at their ends close to the counterpressure rail 30 or the blade edge 28, and have different axial lengths due to the inclination at which the blade extends, so that the line connecting their free ends extends substantially parallel to the blade 28. Each of the upper feed rollers 34*a*, 32*b* and 32*c* can, as shown for example by the upper roller 34*a* in FIG. 3, be journaled at both sides and provided with two fluid cylinders 36 for exerting pressure, in order to achieve as stable a distribution of the pressing forces as possible.

From FIG. 1 it can be seen that the upper feed rollers 34 are arranged in the series of the pressing rollers 24 and in fact in such a manner that, in the region in which the feed rollers 34 are located, one feed roller 34 alternates with one pressing roller 24. By this alternating arrangement, it should be ensured that despite the provision of the upper feed rollers 34, the pressing of the cant against the blade with sufficient pressure distribution over the length of the blade is ensured. It should be also mentioned that only the pressing rollers 24 urge the cant 14 against the blade, while the feed roller pairs 32*a–32c*, 34*a–34c* clamp the cant tightly between them and by the drive move it forwardly, but in contrast to the pressing rollers 24, their vertical height location is freely adjustable.

As can also be seen from FIGS. 1 and 2, further feed roller pairs 42 to 48 are provided in the input region of the device and in the output region of the device, i.e before and after the blade arrangement. These feed roller pairs, which are already described in detail in German Published Application 37 02 909, serve substantially in the present arrangement to supplement the feeding by the roller pairs 32*a–32c*, 34*a–34c* and for the infeed of the cant into the machine and the final delivery of the cant from the machine.

The pressure exerted by the feed roller pairs is automatically regulated by control devices (not illustrated). These control devices can for example comprise photocells. So long as no cant is present in the machine, the feed rollers and also the pressing rollers must be unloaded. By means of the photocells, passage of the leading end of a cant past a feed roller pair is detected in order to immediately subject the latter to pressure. Likewise, pressure relief must occur shortly before the trailing end of a cant leaves a feed roller pair.

I claim:

1. A device for the production of thin boards by the chip-free slicing removal of thin boards from timber in the form of a log or cant, said device comprising means defining a feed path for the timber;

a slicing device located at one side of said feed path;

said slicing device including a fixed or vibratable cutting blade for severing a board;

a counterpressure rail, mounted before said cutting blade, the spacing of said counterpressure rail from said cutting blade, transversely of said feed path, substantially determining the thickness of the board to be removed;

a support table having a flat surface upon which the timber is supported;

said counterpressure rail being part of said support table;

said cutting blade and said counterpressure rail subtending an acute angle with the feed path of the timber;

a pressing device opposite said slicing device at the other side of the feed path, said pressing device comprising a series of pressing rollers adapted to press against the timber; and, feed means for feeding the timber against said cutting blade along the feed path;

said feed means comprising at least two pairs of feed rollers for engaging the timber at opposite sides and clamping the timber therebetween and means for allowing free movement of each said pair of feed rollers as a discrete pair in a transverse direction relative to the feed direction and wherein upper rollers of said feed roller pairs are disposed in the series of said pressing rollers;

at least one pair of said feed rollers being located at an area of the feed path over which said blade extends and including a feed roller located in the area over which said blade extends and journaled so as to overhang laterally and to extend into a recess in said support table.

2. A device according to claim 1, wherein said feed means comprises an operating cylinder associated with each feed roller of the at least one pair of feed rollers for clamping said feed rollers onto the timber, said operating cylinders of said at least one feed roller pair being fixedly mounted and a flow duct interconnecting the interiors of said operating cylinders and wherein the means for allowing free transverse movement of the at least one pair of feed rollers comprises a fluid communication between the interiors of the operating cylinders.

3. A device according to claim 1, wherein said at least one pair of feed rollers is located in a region over which said blade extends, at a third portion of said region located at an inlet end of said region.

4. A device according to claim 1, wherein at least two of said feed roller pairs are located in the region over which said blade extends.

5. A device according to claim 4, wherein said feed roller pairs include lower feed rollers which decrease in length from an inlet region of said blade to an outlet region thereof so that ends of said lower feed rollers lie on an imaginary line substantially parallel to the cutting edge of said blade.

6. A device according to claim 1, in which said upper rollers of said feed roller pairs alternate with said pressing rollers.

7. A device as claimed in claim 6, wherein said pressing device includes an endless pressing belt extending around said pressing rollers and said upper rollers of said feed roller pairs and means for guiding said endless belt along the timber.

8. A device for the production of thin boards by the chip-free slicing removal of thin boards from timber in the form of a log or cant, said device comprising means defining a feed path for the timber;

a slicing device located at one side of said feed path;

said slicing device including a fixed or vibratable cutting blade for severing a board;

a counterpressure rail, mounted before said cutting blade, the spacing of said counterpressure rail from said cutting blade, transversely of said feed path, substantially determining the thickness of the board to be removed;

a support table having a flat surface upon which the timber is supported which may be adjusted in elevation relative to said blade;

said counterpressure rail being part of said support table;

said cutting blade and said counterpressure rail subtending an acute angle with the feed path of the timber;

a pressing device opposite said slicing device at the other side of the feed path, said pressing device comprising a series of pressing rollers adapted to press from above against the timber and thus against said opposite slicing device; and, feed means for feeding the timber against said cutting blade along the feed path;

said feed means comprising at least two pairs of feed rollers for engaging the timber at opposite sides and clamping the timber therebetween and means for allowing free movement of each said pair of feed rollers as a discrete pair in a transverse direction relative to the feed direction and wherein upper rollers of said feed roller pairs are disposed in the series of said pressing rollers;

at least one pair of said feed rollers being located at an area of the feed path over which said blade extends and including a feed roller of the at least one pair of feed rollers located within the area over which said blade extends and journaled so as to overhang laterally and to extend into a recess in said support table.

9. A device according to claim 8, wherein said feed means comprises an operating cylinder associated with each feed roller of the at least one pair of feed rollers for clamping said feed rollers onto the timber, said operating cylinders of said at least one feed roller pair being fixedly mounted and a flow duct interconnecting the interiors of said operating cylinders and wherein the means for allowing free transverse movement of the at least one pair of feed rollers comprises a fluid communication between the interiors of the operating cylinders.

10. A device according to claim 8, wherein said at least one pair of feed rollers is located in a region over which said blade extends, at a third portion of said region located at an inlet end of said region.

11. A device according to claim 8, wherein at least two of said feed roller pairs are located in the region over which said blade extends.

12. A device according to claim 11, wherein said feed roller pairs include lower feed rollers which decrease in length from an inlet region of said blade to an outlet region thereof so that ends of said lower feed rollers lie on an imaginary line substantially parallel to the cutting edge of said blade.

13. A device according to claim 8, in which said upper rollers of said feed roller pairs alternate with said pressing rollers.

14. A device as claimed in claim 13, wherein said pressing device includes an endless pressing belt extending around said pressing rollers and said upper rollers of said feed roller pairs and means for guiding said endless belt along the timber.

* * * * *